US009959710B2

(12) United States Patent
Diamantis

(10) Patent No.: US 9,959,710 B2
(45) Date of Patent: May 1, 2018

(54) PROXIMITY BASED GAMES AND COMPUTER-IMPLEMENTED METHODS AND COMPUTER SYSTEMS FOR PLAYING THEREOF

(71) Applicant: Intralot S.A.—Integrated Lottery Systems and Services, Athens (GR)

(72) Inventor: Nikolaos Diamantis, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 83 days.

(21) Appl. No.: 14/711,616

(22) Filed: May 13, 2015

(65) Prior Publication Data

US 2015/0332541 A1 Nov. 19, 2015

Related U.S. Application Data

(60) Provisional application No. 61/992,760, filed on May 13, 2014.

(51) Int. Cl.
*G07F 17/32* (2006.01)

(52) U.S. Cl.
CPC ..... *G07F 17/3276* (2013.01); *G07F 17/326* (2013.01); *G07F 17/329* (2013.01)

(58) Field of Classification Search
CPC ... G07F 17/3276; G07F 17/326; G07F 17/329
See application file for complete search history.

(56) References Cited

U.S. PATENT DOCUMENTS 8,342,959 B2 1/2013 Mahaffey et al.
2003/0114211 A1* 6/2003 White ..... G07F 17/32 463/17
2009/0247259 A1* 10/2009 Napolitano ..... G07F 17/3244 463/18

(Continued)

FOREIGN PATENT DOCUMENTS

WO 2014/045212 A2 3/2014

OTHER PUBLICATIONS

International Search Report and Written Opinion from International Application No. PCT/IB2015/001467 dated Oct. 30, 2015.

*Primary Examiner* — Tramar Harper
*Assistant Examiner* — Jeffrey Wong
(74) *Attorney, Agent, or Firm* — Greenberg Traurig, LLP

(57) ABSTRACT

The present invention provides for a game-operating computer system, including: at least one server and game-operating software stored on a non-transient computer readable medium accessible by the server, where the at least one server, executing game-operating software, is at least configured to: generate an instance of a proximity game, where the instance of the proximity game is played based on the following rules: a) selecting a plurality of winning values from a pool of values, b) electronically receiving a first plurality of player-selected values from the pool of values, c) electronically receiving a second plurality of player-selected values from the pool of values, d) comparing the player-selected values with the winning values, where at least one player-selected value is not equal to at least one winning values; and e) determining at least one winning player from the at least one first player and the at least one second player.

10 Claims, 13 Drawing Sheets

(56) References Cited

U.S. PATENT DOCUMENTS

2009/0264177 A1* 10/2009 Walker ..... G07F 17/32
463/17
2014/0011560 A1 1/2014 Konstakis et al.

* cited by examiner

PROXIMITY BASED GAMES AND COMPUTER-IMPLEMENTED METHODS AND COMPUTER SYSTEMS FOR PLAYING THEREOF

RELATED APPLICATIONS

This application claims the priority of U.S. provisional application Patent No. 61/992,760; filed May 13, 2014; entitled "METHODS AND SYSTEMS FOR PROXIMITY BASED LOTTERY GAMES," which is incorporated herein by reference in its entirety for all purposes.

TECHNICAL FIELD

In some embodiments, the instant invention is related to computer methods/systems to conduct and play games.

BACKGROUND

To win a lottery game, a player typically must choose numbers that exactly match game winning numbers as defined by the lottery game.

SUMMARY OF INVENTION

In some embodiments, the instant invention provides for a game-operating computer system, including: at least one server and game-operating software stored on a non-transient computer readable medium accessible by the at least one server, where the at least one server, executing game-operating software, is at least configured to: generate, in real time, an instance of a proximity game, where the instance of the proximity game is played based, at least in part, on the following rules: a) selecting, in real time, by the game-operating software, a plurality of winning values from a pool of values, where the plurality of winning values include: (1) A as a first selected winning value, (2) B as a second selected winning value, and (3) C as a third selected winning value; b) electronically receiving, in real time, from at least one first player of the plurality of players, via a first graphical user interface, a first plurality of player-selected values from the pool of values, where the first plurality of player-selected values include: (1) X(1) value, (2) Y(1) value, and (3) Z(1) value; c) electronically receiving, in real time, from at least one second player of the plurality of players, via a second graphical user interface, a second plurality of player-selected values from the pool of values, where the second plurality of player-selected values include: (1) X(2) value, (2) Y(2) value, and (3) Z(2) value; d) comparing, in real time, by the game-operating software, the A, B, and C values to: i) the X(1), Y(1), and Z(1) values selected by the at least one first player, and ii) the X(2), Y(2), and Z(2) values selected by the at least one second player, by at least: calculating, in real time, a first proximity of the A, B, and C values to the X(1), Y(1), and Z(1) values based, at least in part, on at least one predetermined comparing order; calculating, in real time, a second proximity of the A, B, and C values to the X(2), Y(2), and Z(2) values based, at least in part, on the at least one predetermined comparing order; where at least one player-selected value of the X(1), Y(1), and Z(1) values is not equal to at least one winning value of the A, B, and C values; and where at least one player-selected value of the X(2), Y(2), and Z(2) values is not equal to at least one winning value of the A, B, and C values; and e) determining, in real time, by the game-operating software, at least one winning player from the at least one first player and the at least one second player, based, at least in part, on: comparing, in real time, by the game-operating software, the first proximity to the second proximity.

In some embodiments, the proximity game is further based, at least in part, on the following rule: distributing, in real time, by the game-operating software, a prize to the at least one winning player. In some embodiments, the game-operating software, is further configured to: receive, in real time, a first payment from the at least one first player of the plurality of players and a second payment from the at least one second player of the plurality of players. In some embodiments, the pool of values corresponds to at least one point in a geometric space, at least one color, at least one auditory note, at least one geographic location, at least one event, at least one description of taste, or any combination thereof. In some embodiments, the at least one event includes historical events, political events, cultural events, financial events, athletic events, musical events, or any combination thereof. In some embodiments, (i) X(1) is compared to A; (ii) Y(1) is compared to B; (iii) Z(1) is compared to C; and the first proximity is calculated using a first Euclidean formula:

$$\sqrt{(A-X(1))^2+(B-Y(1))^2+\ldots+(C-Z(1))^2}; \text{ and}$$

(i) X(2) is compared to A; (ii) Y(2) is compared to B; (iii) Z(2) is compared to C; and the second proximity is calculated using a second Euclidean formula:

$$\sqrt{(A-X(2))^2+(B-Y(2))^2+\ldots+(C-Z(2))^2}.$$

In some embodiments, the A, B, and C values correlate with the at least one point in the three-dimensional space, defined by: (i) an X-coordinate, (ii) a Y-coordinate, and (iii) a Z-coordinate.

In some embodiments, the instant invention provides for a game-operating computer method, including: generating, in real time, by at least one server and game-operating software stored on a non-transient computer readable medium accessible by the at least one server, an instance of a proximity game, where the instance of the proximity game is played based, at least in part, on the following rules: a) selecting, in real time, by the game-operating software, a plurality of winning values from a pool of values, where the plurality of winning values includes: (1) A as a first selected winning value, (2) B as a second selected winning value, and (3) C as a third selected winning value; b) electronically receiving, in real time, from at least one first player of the plurality of players, via a first graphical user interface, a first plurality of player-selected values from the pool of values, where the first plurality of player-selected values include: (1) X(1) value, (2) Y(1) value, and (3) Z(1) value; c) electronically receiving, in real time, from at least one second player of the plurality of players, via a second graphical user interface, a second plurality of player-selected values from the pool of values, where the second plurality of player-selected values include: (1) X(2) value, (2) Y(2) value, and (3) Z(2) value; d) comparing, in real time, by the game-operating software, the A, B, and C values to: i) the X(1), Y(1), and Z(1) values selected by the at least one first player, and ii) the X(2), Y(2), and Z(2) values selected by the at least one second player, by at least: calculating, in real time, a first proximity of the A, B, and C values to the X(1), Y(1), and Z(1) values based, at least in part, on at least one predetermined comparing order; calculating, in real time, a second proximity of the A, B, and C values to the X(2), Y(2), and Z(2) values based, at least in part, on the at least one predetermined comparing order; where at least one player-selected value of the X(1), Y(1), and Z(1) values is not equal to at least one winning value of the A, B, and C values; and where at least one player-selected value of the X(2), Y(2), and Z(2) values is not equal to at least one winning value of the A, B, and C values; and e) determining, in real time, by the game-operating software, at least one winning player from the at least one first player and the at least one second player, based, at least in part, on: comparing, in real time, by the game-operating software, the first proximity to the second proximity.

In some embodiments, the proximity game is further based, at least in part, on the following rule: distributing, in real time, by the game-operating software, a prize to the at least one winning player. In some embodiments, the game-operating computer method further includes: receiving, in real time, a first payment from the at least one first player of the plurality of players and a second payment from the at least one second player of the plurality of players. In some embodiments, the pool of values corresponds to at least one point in a geometric space, at least one color, at least one auditory note, at least one geographic location, at least one event, at least one description of taste, or any combination thereof. In some embodiments, the at least one event includes historical events, political events, cultural events, financial events, athletic events, musical events, or any combination thereof. In some embodiments, (i) X(1) is compared to A; (ii) Y(1) is compared to B; (iii) Z(1) is compared to C; and the first proximity is calculated using a first Euclidean formula:

$$\sqrt{(A-X(1))^2+(B-Y(1))^2+\ldots+(C-Z(1))^2}; \text{ and}$$

(i) X(2) is compared to A; (ii) Y(2) is compared to B; (iii) Z(2) is compared to C; and the second proximity is calculated using a second Euclidean formula:

$$\sqrt{(A-X(2))^2+(B-Y(2))^2+\ldots+(C-Z(2))^2}.$$

In some embodiments, the A, B, and C values correlate with the at least one point in the three-dimensional space, defined by: (i) an X-coordinate, (ii) a Y-coordinate, and (iii) a Z-coordinate.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Figure 1:
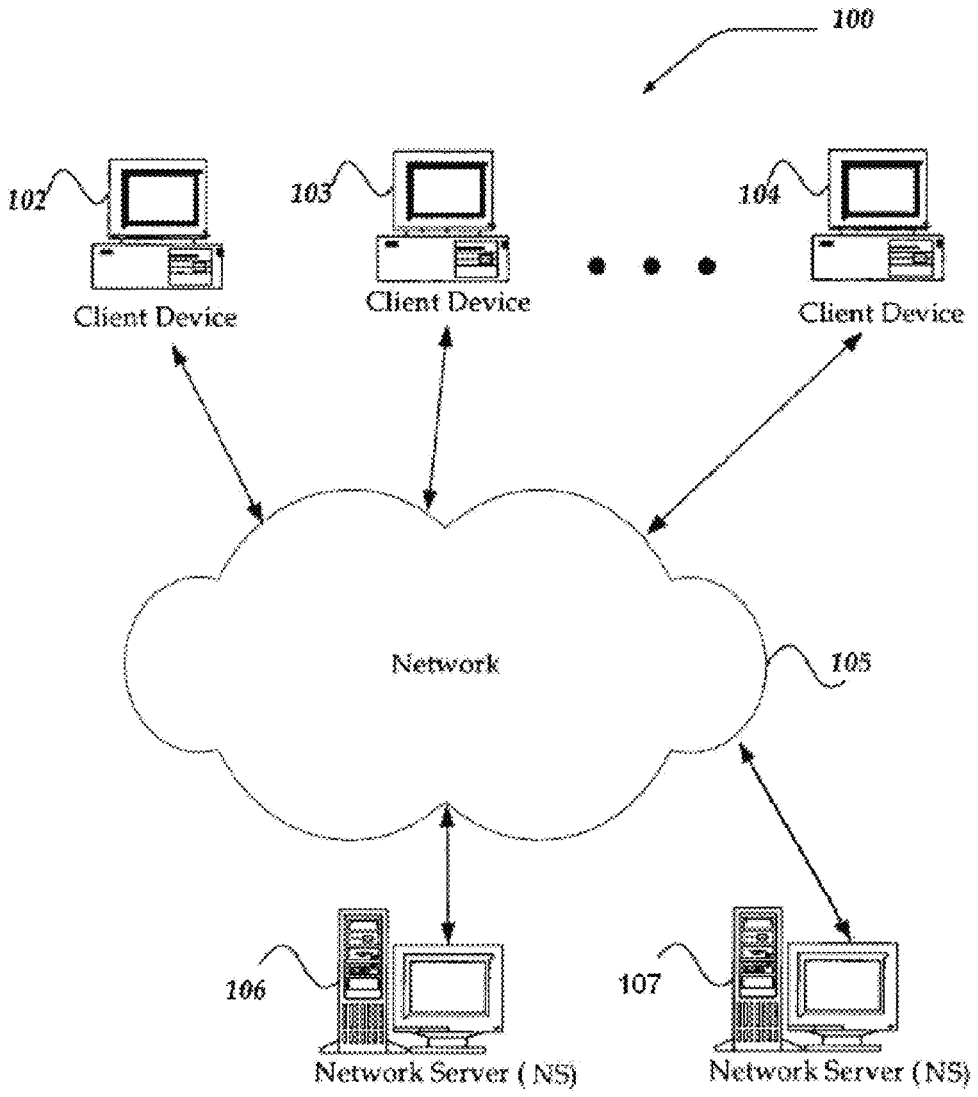
FIGS. 1-4 illustrate some aspects of some embodiments in accordance with the present invention.

In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DESCRIPTION OF EXEMPLARY EMBODIMENTS

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

It is understood that at least one aspect/functionality of various embodiments described herein can be performed in real-time and dynamically. As used herein, the term "real-time" means that an event/action can occur instantaneously or almost instantaneously in time when another event/action has occurred.

As used herein, the term "dynamic(ly)" means that an event/action that can occur without any human intervention. The event/action may be in real-time and/or hourly, daily, weekly, monthly, etc.

As used herein, in some embodiments, the terms "probability space" and "probability spaces" are directed to a particular point in a space (e.g., a 2 dimensional (2D) plane, a 3D area, and/or a "n"-D area) and/or a particular area of the space.

As used herein, in some embodiments, the terms "proximity" and "proximities" are directed to the distance(s) or difference(s) between at least two particular points and is/are calculated utilizing, but is not limited to, the following exemplary Euclidean formula: where "p" and "q" are points:

$$\sqrt[1]{(q_1-p_1)^2+(q_2-p_2)^2+\ldots+(q_n-p_n)^2}.$$

In an embodiment, three points/numbers (A, B, and C) are compared to three different points/numbers (X, Y, and Z) by the following equation:

$$\text{proximity}=\sqrt[1]{(X-A)^2+(Y-B)^2+(Z-C)^2}.$$

In some embodiments, four points/numbers are compared by the Euclidean formula. In some embodiments, five points/numbers are compared by the Euclidean formula.

As used herein, the terms "proximity winning" and "proximity winnings" are directed to at least one calculated Euclidean distance to at least one winning parameter, where the proximity winning(s) is/are achieved without exact match(es).

While examples provided in the description are primarily directed to playing and conducting proximity games, those examples are not restrictive and other types of wager and non-wager games can be played and/or conducted in accordance with the principles of the exemplary embodiments of the instant invention that are disclosed herein. In some embodiments, a lottery game is a wager or a non-wager game.

In some embodiments, the game system(s) of the present invention can allow a player to play the game prior to payment, where the player is not informed of the player's result (i.e., the player does not know if the player won) and then, obtains a payment from the player prior to delivering a winning/losing status to the player. In some embodiments, the game system(s) of the present invention can allow a player to play the game after payment.

In some embodiments, the game system(s) of the present invention can include the use of electronic mobile devices (e.g., smartphones, etc.) of players and server(s) in the distributed network environment, communicating over a suitable data communication network (e.g., the Internet, etc.) and utilizing at least one suitable data communication protocol (e.g., IPX/SPX, X.25, AX.25, AppleTalk, TCP/IP (e.g., HTTP), etc.).

In some embodiments, the game-operating system(s) of the present invention are configured to deliver a proximity game to each player of a plurality of players (e.g., but not limited to, at least 1,000 players, at least 10,000 players, at least 100,000 players, etc.) by use of a plurality of graphical user interfaces (GUIs) (e.g., but not limited to, at least 1,000 GUIs at least 10,000 GUIs, at least 100,000 GUIs, etc.).

In some embodiments, the game-operating system(s) of the present invention include providing a series of values for each player of a plurality of players in which to choose values; where the series of values can include 2, 3, 4, 5, 6, 7, 8, 9, 10, 11, 12, 13, 14, 15, etc., values. As a non-limiting example, a series of values can include 3 values, where each of the values correlate with X, Y, and Z coordinates, where the X, Y, and Z coordinates identify a point in a geometric space, e.g., but not limited to, a point in a cube. In a second non-limiting example, a series of values can include 4 values, where each of the values correlate with A, B, C, and D auditory pitches, where the A, B, C, and D auditory pitches generate a musical motif (e.g., the first four pitches correlate with the first four musical notes of the song "Happy Birthday").

In some embodiments, the game-operating system(s) of the present invention are configured to compare A, B, and C values sequentially with X, Y, and Z, where A is compared with X, B is compared with Y, and C is compared with Z. In some embodiments, the game-operating system(s) of the present invention are configured to compare A, B, and C values non-sequentially with X, Y, and Z, where A is compared with Y, B is compared with Z, and C is compared with X.

In some embodiments, the game-operating system(s) of the present invention can generate proximity games, where each of the proximity games can allow for group participation. As a non-limiting exemplary embodiment, three players can form a group and each player can choose a number, totaling 3 player-chosen numbers, and these 3 player-chosen numbers are then compared with 3 numbers previously selected by the game-operating system.

In some embodiments, the game-operating system(s) of the present invention can generate proximity games, where each of the proximity games can allow for individual participation.

In some embodiments, the game-operating system(s) of the present invention can generate proximity games, where each of the proximity games can allow for head-to-head competition between at least two players (e.g., 2, 3, 4, 5, 6, 7, 8, 9, 10, etc., players).

In some embodiments, the game-operating system(s) of the present invention can generate proximity games, where each of the proximity games can allow for groups to compete against each other, where there are at least two groups (e.g., 2, 3, 4, 5, 6, 7, 8, 9, 10, etc., groups).

In some embodiments, the game-operating system(s) of the present invention can generate proximity games, where each of the proximity games can allow for prize distribution amongst each of the players in the group.

In some embodiments, the game-operating system(s) of the present invention can generate proximity games, where each of the proximity games can compare player-selected values to at least one reference point. In some embodiments, the player-selected values can be, but are not limited to, 1%, 5%, 10%, 15%, 20%, 25%, etc. away from a reference point.

In some embodiments, the game-operating system(s) of the present invention can generate proximity games, where each of the proximity games can allow a single player to play a proximity game against the game-operating system itself.

In some embodiments, the present invention is directed to a game-operating method that includes at least the steps of: receiving, by at least one specifically programmed computer system, at least one first indication indicating that at least one first player desires to participate in at least one game; receiving, by the at least one specifically programmed computer system, at least one first payment for playing the at least one game from the at least one first player; receiving, by the at least one specifically programmed computer system, at least three selected numbers (X, Y, Z) selected from a pool of numbers, selecting, by the at least one specifically programmed computer system, at least three winning numbers (A, B, C) from the pool of numbers, where a sequence of the at least three selected numbers (X, Y, Z) respectively corresponds to a sequence of the at least three winning numbers (A, B, C); comparing a first selected number, X, to a first winning number, A; comparing a second selected number, Y, to a second winning number, B; comparing a third selected number, Z, to a third winning number C; calculating, by the at least one specifically programmed computer system, a proximity of the at least three selected numbers (X, Y, Z) to the at least three winning numbers (A, B, C), wherein the proximity is calculated using the following formula:

$$\text{proximity}=\sqrt{(X-A)^2+(Y-B)^2)+(Z-C)^2}.$$

In some embodiments, a first difference, (X−A), does not equal zero. In some embodiments, a second difference, (Y−B), does not equal zero. In some embodiments, a third difference, (Z−C), does not equal zero. In some embodiments, the computer-implemented method further includes at least steps of: distributing, by the at least one specifically programmed computer system, at least one prize based on the proximity. In some embodiments, the first difference, (X−A), equals zero. In some embodiments, the second difference, (Y−B), equals zero. In some embodiments, the third difference, (Z−C), equals zero. In some embodiments, A=X, B=Y, and C=Z, wherein the at least three selected numbers (X, Y, Z) are an exact match when compared to the winning numbers (A, B, C).

In some embodiments, the illustrative game-operated computer-implemented methods of the instant invention can further include steps of: selecting and/or collecting data and/or predictions from at least one user input and/or at least one electronic data source, and then comparing the at least one user input and/or data from the at least one electronic data source to how close in proximity the at least one user input and/or the data from the at least one electronic data source is/are to the at least one winning selection and/or betting outcome.

In some embodiments, the exemplary game-operating computer-implemented methods of the present invention can utilize at least one selection, where the selection corresponds and/or describes at least one real world (physical) property, where the at least one real world (physical) property is movement, time, sound, colors, and/or urban landscape, or any combination thereof. In some embodiments, a mathematical model comprises a 2D, 3D, 4D, or "n" dimension space, where the space facilitates calculating a proximity of the at least one user input and/or the data from the at least one electronic source to at least one winning selection and/or betting outcome. In some embodiments, at least one selection of the at least one input data, the data from the at least one electronic source, at least one drawing procedure, and/or at least one proximity calculation includes a specifically programmed personal computing device, where the specifically programmed personal computing device provides operation of the exemplary computer-implemented methods. In some embodiments, at least one prize is awarded, based on the proximity of the at least one user input and/or the data from the at least one electronic source to the at least one winning selection(s) and/or betting outcome(s).

In some embodiments, the exemplary computer-implemented methods of the present invention can utilize at least one selection, where the selection corresponds and/or describes at least one virtual world (Internet-based) property, where the at least one virtual world (Internet-based) property is movement, time, sound, colors, and/or urban landscape of any virtual presentation, or any combination thereof.

In some embodiments, In some embodiments, the selected and winning numbers correspond to at least one point(s), color(s), note(s), geographic location(s), historical event(s), political event(s), description(s) of taste(s), and/or any combination thereof.

In some embodiments, the present invention can be based on fixed-odds betting based on particular outcomes(s) of particular event(s). In some embodiments, the fixed odds betting can include, but is not limited to, direction and extent of movement of various financial indices, winning/participation in television competitions such as, e.g., Big Brother, and various civil and corporate elections. In some embodiments, the present invention can be applicable, but is not limited to, at least one of: at least one sport (including, but not limited to, boxing, baseball, football, soccer, basketball, tennis, swimming, long-distance running, sprinting, wrestling, ice hockey, hockey, lacrosse, table tennis, squash, volleyball, skiing, skating, ice skating, snowboarding, snow shoeing, ultimate fighting, horse racing, and/or animal confrontations); at least one life event (including but not limited to engagement(s), wedding(s), birth(s) (date/time/sex of child(ren)/number of children); graduation from at least one academic institution, etc.); politics (at least one candidate(s) winning/losing); at least one legal event(s) (e.g., trial(s)); weather pattern(s); crop supply or lack thereof, crop demand or lack thereof; award show(s); news event(s); chronology of a song list at a live concert(s); a medical outcome(s); or any combination thereof. In some embodiments, one person/user can also bet with another person/user that a statement is true or false, or that at least one specified event(s) will happen (a "back bet"), or will not happen (a "lay bet") within a specified time.

FIG. 1 illustrates some aspects of some embodiments in accordance with the present invention.

Figure 2:
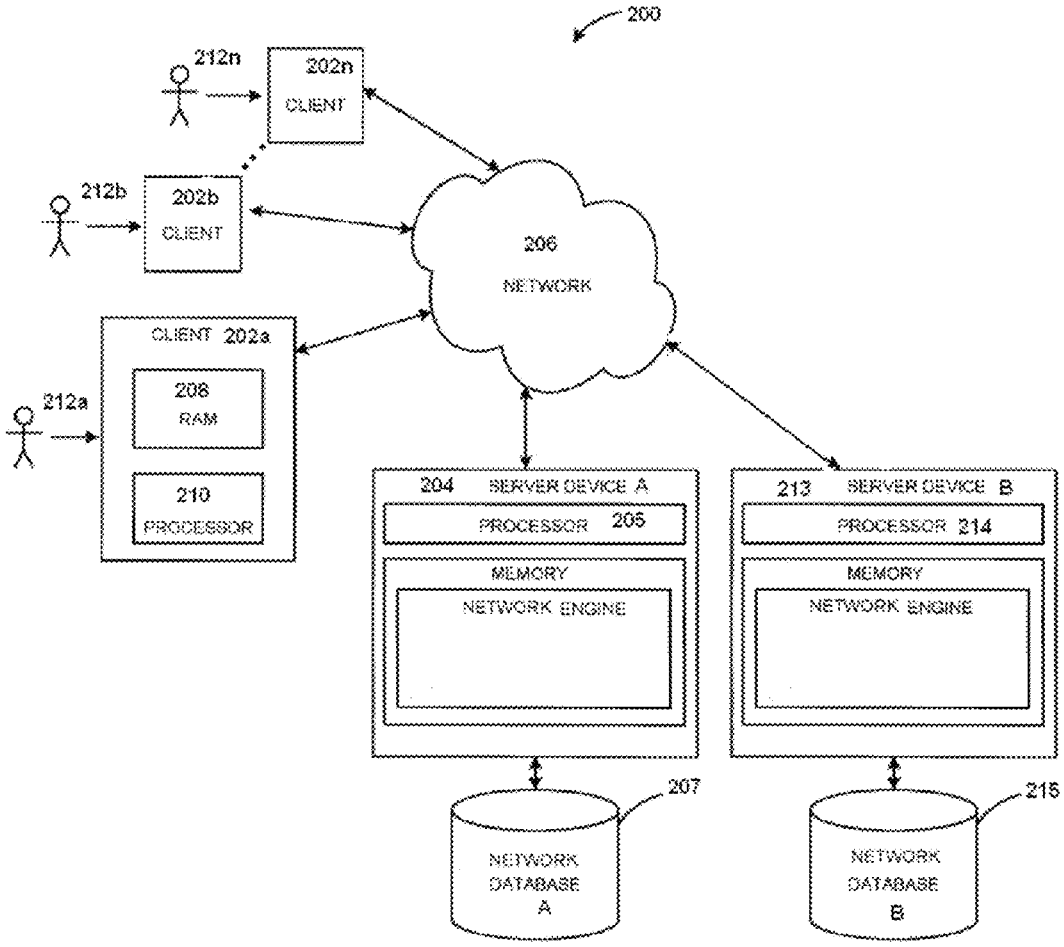

FIG. 2 illustrates an embodiment of the network architecture of the present invention.

Figure 3:
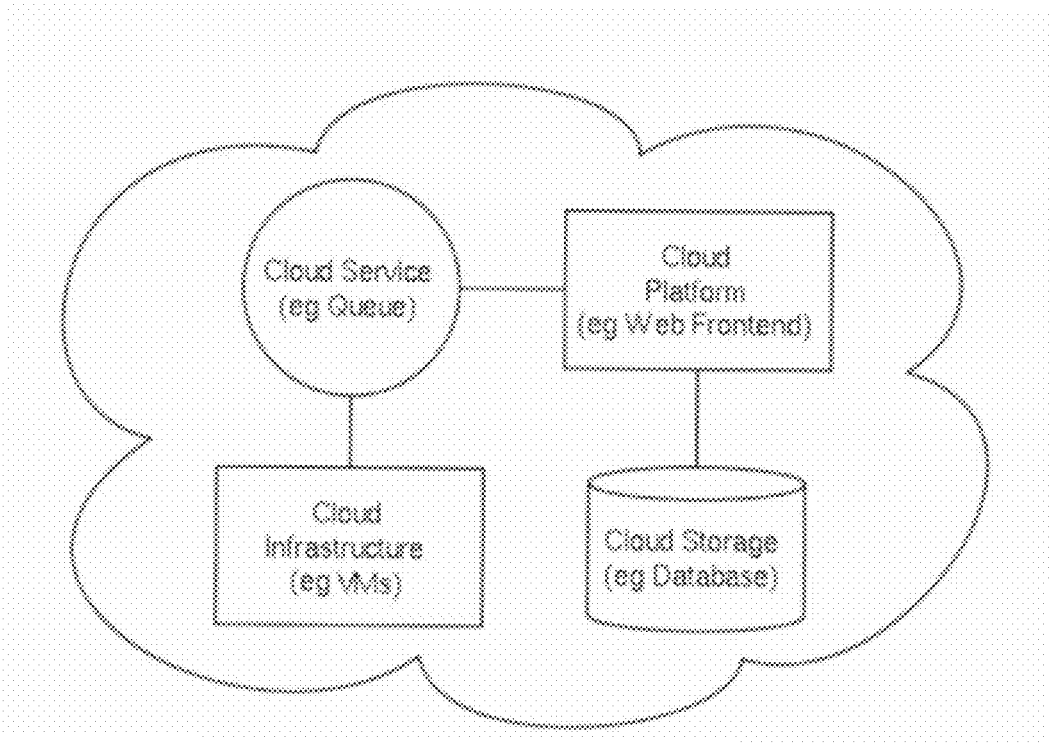
Figure 4:
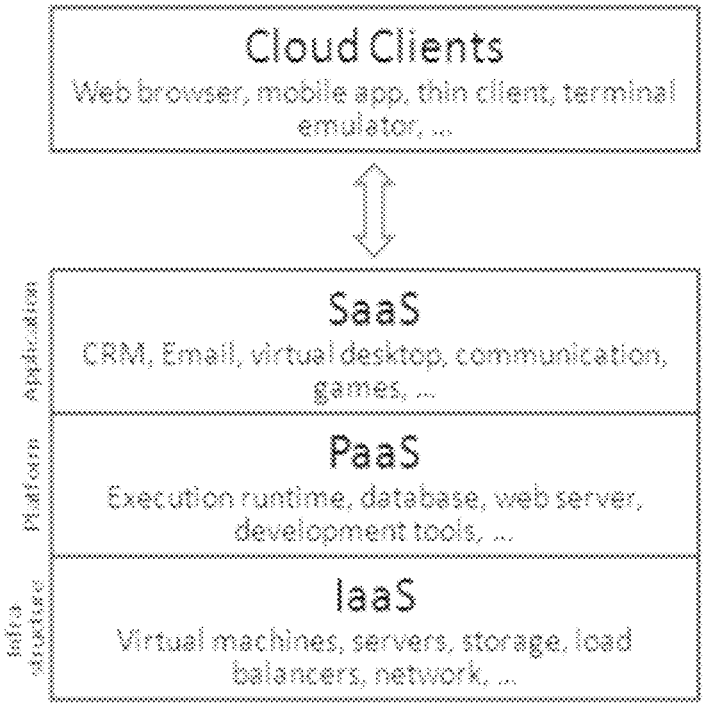

FIGS. 3 and 4 illustrate some further aspects of some embodiments of the present invention.

Figure 5:
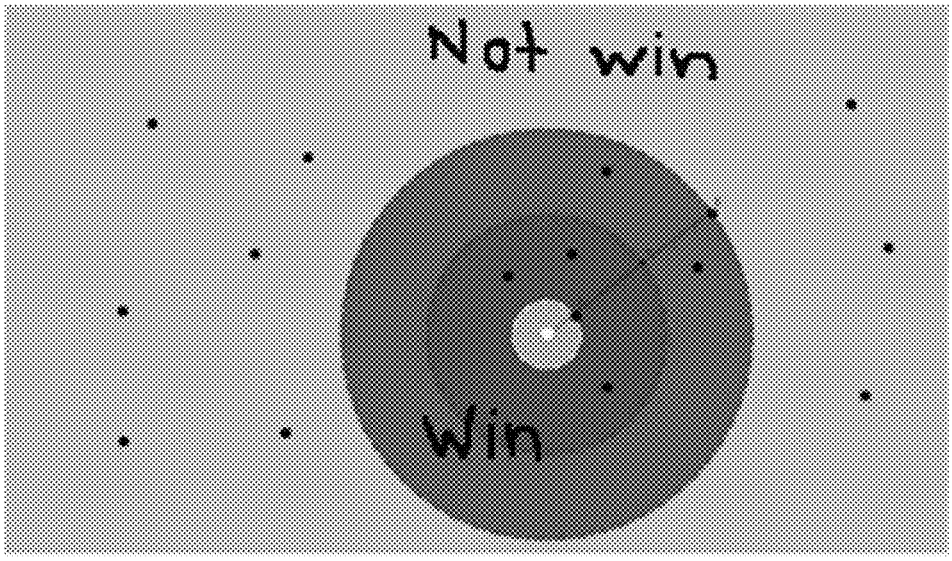
FIG. 5 illustrates an embodiment of the proximity game of the present invention, indicating at least one winning point closest to a target.

FIG. 5 illustrates some further aspects of some embodiments in accordance with the present invention. In some embodiments, the probability space(s) is/are infinite. In some embodiments, the probability space(s) is/are finite. In some embodiments, at least one user selects at least one point in a 2D plane. In some embodiments, at least one user selects at least one point in a 3D space. In some embodiments, at least one user selects at least one point in a 4D space. In an embodiment, FIG. 5 illustrates at least three circular winning zones placed around a winning point selected by the specifically programmed computer. In some embodiments, the winning point was randomly selected on the 2D space. In some embodiments, at least one point that falls within a first zone (the innermost circle of the three circles) around the winning point generates the highest prize. In an embodiment, FIG. 5 illustrates that a computer-implemented method identifies at least one user's selection of falling within a second zone (middle circle) or a third zone (outer circle) and awards decreasing prize(s). In some embodiments, point(s) that is/are not within any winning zone is/are non-winner(s).

Figure 6:
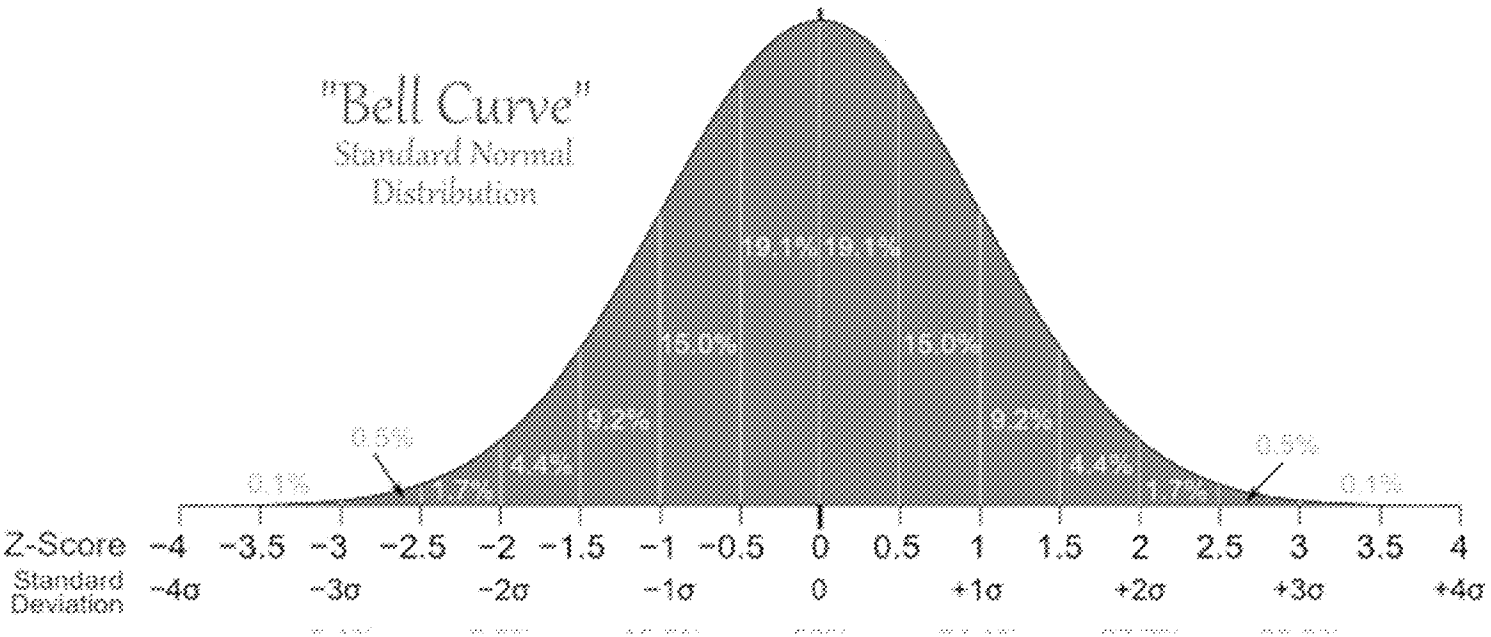
FIG. 6 illustrates a bell curve for use in embodiments of the proximity games generated by the system of the present invention.

FIG. 6 illustrates some further aspects of the present invention. In some embodiments, at least one of winning zone(s) is directed to being determined by at least one lottery. In some embodiments, at least one of winning zone(s) is directed to being determined and/or calculated by at least one mathematical property and/or probability of at least one lottery. In some embodiments, at least one user selecting at least one number that falls within a first zone is awarded at least one portion of a at least one jackpot prize by a computer-implemented method. In some embodiments, the first zone is directed to being closer to the winning point and a computer-implemented method will award at least one point(s) within the first zone at least one portion of at least one jackpot prize. In some embodiments, the computer-implemented method identifies at least one winning within a second zone and awards at least one prize, comprising at least one smaller portion of at least one jackpot prize compared to the portion awarded to at least one user having selected a point within the first zone, e.g., half of a jackpot prize of the jackpot prize awarded when within the first zone. In some embodiments, the second zone is directed to be further, and/or has a higher difference compared with the first zone and thus has a reduced proximity to the winning point, where the winning point borders on jackpot zone 1. In some embodiments, at least one user having selected at least one point within a third zone is awarded at least one portion of at least one jackpot that is smaller than a portion awarded to at least one user having selected at least one point within a first or second zone, e.g., a quarter of the jackpot prize. In some embodiments, a prize falls logarithmically within each zone. In some embodiments, at least one prize is directed to be distributed by a bell distribution/bell curve. In some embodiments, a highest prize is directed to be awarded for selecting a winning point, as shown in FIG. 6, and as each point is further from the winning point, each prize in connection with further points decreases exponentially, where the decrease is symmetrical (e.g., at least one prize awarded+10 points away from the winning point matches at least one prize awarded −10 points away from the winning point).

Figure 7:
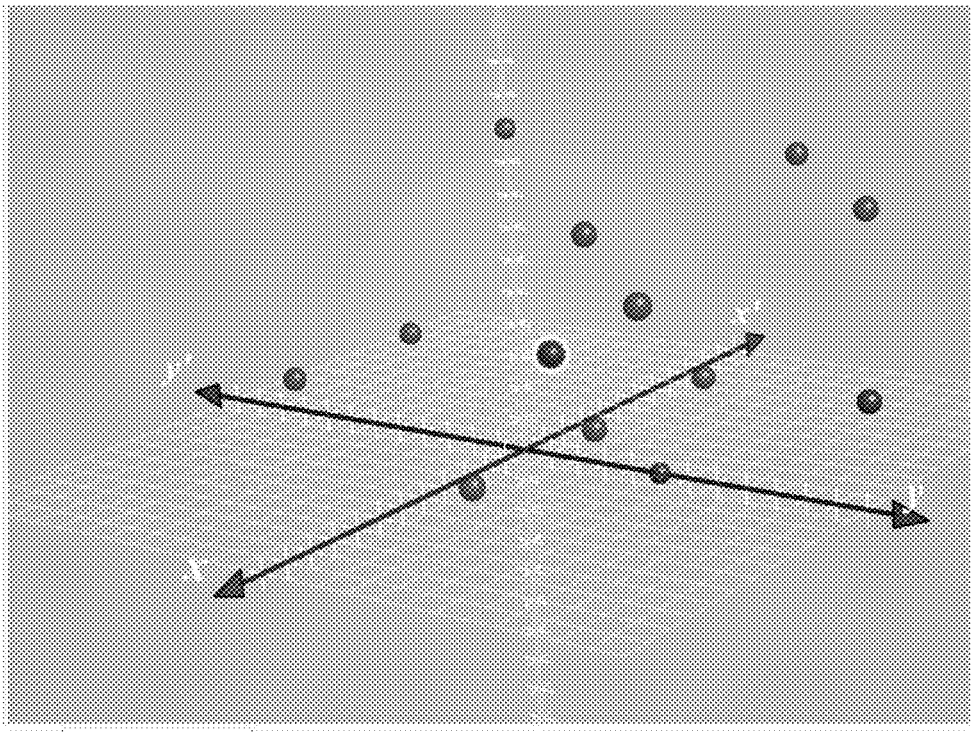
FIG. 7 illustrates a three-dimensional space showing the location of several points that may be chosen during a proximity game generated by the system of the present invention.

FIG. 7 illustrates some further aspects of the present invention. In some embodiments, at least one user wins, where the at least one win is directed to the closeness/proximity of the selected data (e.g., numbers, colors, pitches, geographic location, historical events etc.) in comparison to the at least one winning number or at least one point. In an embodiment, at least one user selected 3 numbers ranging from 0-9 and a winning occurs if the user selected exactly the 3 numbers in a row or if the user finds 2 numbers, and/or if the user selected the first number only, etc.

In an embodiment, each number exists in a 3D space. In some embodiments, the computer-implemented method includes at least one user selecting an approximation of exact point(s)/number(s). In some embodiments, each number is directed to be transformed into at least one point in 3D space. In some embodiments, the selection method is directed to be visualized by a specifically programmed computing device. In some embodiments, selected point(s) is/are directed to be in a 3D modeling environment. In some embodiments, upon a draw, a winning point will be randomly selected (e.g., utilizing a random number generator). In some embodiments, all points (excluding a winning point) that are directed to be close/in proximity to the winning point are identified by the computer-implemented method as at least one proximity winner. In an embodiment, a Pick3D lottery game illustrates a computer-implemented method in 3D space.

In an embodiment, the present invention includes the parameter of a computer-implemented method delivering a low chance of awarding at least one jackpot. In some embodiments, a low chance of awarding at least one jackpot is directed to a percentage equal to or less than 1%. In some embodiments, a low chance of awarding at least one jackpot is directed to a percentage equal to or less than 0.1%. In some embodiments, a low chance of awarding at least one jackpot is directed to a percentage equal to or less than 0.01%. In some embodiments, a low chance of awarding at least one jackpot is directed to a percentage equal to or less than 0.001%. In some embodiments, a low chance of awarding at least one jackpot is directed to a percentage equal to or less than 0.0001%. In some embodiments, a low chance of awarding at least one jackpot is directed to a percentage equal to or less than 0.00001%. In some embodiments, a low chance of awarding at least one jackpot is directed to a percentage equal to or less than 0.000001%. In some embodiments, a low chance of awarding at least one jackpot is directed to a percentage equal to or less than 0.0000001%. In some embodiments, a low chance of awarding at least one jackpot is directed to a percentage equal to or less than 0.00000001%. In some embodiments, a low chance of awarding at least one jackpot is directed to a percentage equal to or less than 0.000000001%.

In an embodiment, a game includes at least one feature where at least three numbers are selected from between 1-100 and create the probability of 100*100*100=1,000,000 different possible numbers for at least one user to select from; where the chance of a standard jackpot(s) (exact match) is 1/1,000,000, and where at least one standard jackpot prize can be won by only one combination (by at least one user's selection of an exact match). In an embodiment of the present invention, the numbers that are 1 number distance apart from the winning number fall within at least one zone awarding at least one partial jackpot(s), resulting in at least one proximity winning. In an embodiment, the distance of 1 number (N±1, where N is the winning number) from the winning point generates 6 numbers. In an embodiment, a proximity zone 1 contains 6 numbers, so the chance of winning in proximity zone 1 is 6/1,000,000, which equals 1/166,000. In an embodiment, the distance of 1-2 numbers (N±up to 2, where N is the winning number) from the winning point generates 14 numbers. In some embodiments, N is a winning number A, B, C, D, and/or E. In an embodiment, a proximity zone 2 contains 14 numbers, so the chance of winning in proximity zone 2 is 14/1,000,000, which equals 1/70,000. In an embodiment, a distance of a number from the winning number is ±3, ±4, ±5, ±6, through at least ±1,000. In some embodiments, at least one prize is assigned to each winning zone. In an embodiment, at least one proximity distance is computed by the Euclidean formula that measure(s) distance between at least two points in space.

In some embodiments, the inventive methods can include, but is not limited to, at least one parameter of moving object(s) in a 3D space, where point(s) is/are not static and move during at least one lottery drawing and the at least one user selects at least one point in space these points will collide.

In some embodiments, the method includes a fourth dimension in the lottery. In some embodiments, the fourth dimension is a time. In some embodiments, the proximity game/lottery is decided by how 'close' at least one point (i.e. close proximity) is in the 3D space and how close the at least one point is within a time interval to one time point selected, by a specifically programmed computer, in which at least one event takes place.

In some embodiments, at least one lottery occurs on a specifically programmed video-lottery screen. In some embodiments, the specifically programmed video-lottery screen illustrates at least two light balls, insects, animals, shapes, flowers, airplanes, and/or any illustrative object generated by the specifically programmed computer, or any combination therein, moving in 2D and/or 3D space. In some embodiments, the at least one user selects at least one location/time in at least one plane or in at least one space in which the at least two objects will meet and at least one time the at least one meeting will occur. In some embodiments, the at least one user selects the at least one location/time by clicking on at least one point that represents at least one point in space and/or plane and also determining the at least one time from at least one virtual clock. In an embodiment, the at least one user's input and/or data from the at least one electronic data source for a Pick 4D game can be an integer (e.g., 10, 12, 30, 45). In some embodiments, after the computer receives at least one selection, the object(s) start moving randomly in at least one space, and the at least one user selects the at least one point (e.g., 10, 12, 30) where the objects will meet.

In some embodiments, at least one user selects numbers (e.g., 10, 12, 30, 15) predicting at least one winning point in space, and the numbers (10, 12, 30, 15) are not an exact match compared to the winning numbers (10, 12, 30, 45) selected by the specifically programmed computer. In some embodiments, the exemplary Euclidean Distance in the 4D space, based on the first user input and/or data from the at least one electronic data source to the winning event, is, e.g., 30, and a second user selects numbers (e.g., 8, 10, 28, 43), and achieved a closer Euclidean distance, e.g., less than 30. In some embodiments, the second user has selected numbers in closer proximity compared with the first user. In some embodiments, the second user wins at least one larger prize (at least one portion of a jackpot) compared to the first user although the first user matched three of four numbers and the second user matched none of the numbers.

In some embodiments, at least two and/or multiple versions of at least one lottery game are provided to at least one user, for example, at least one 'hybrid' game combines characteristics of both at least one traditional lottery game and gives at least one user at least one chance to win in at least two different ways, by exact match and by proximity.

In some embodiments, a computer-implemented method simulates at least one insect's (e.g., a fly, a bee, a hornet, a ladybug, etc.) journey(s) inside of at least one room. In some embodiments, upon beginning of the draw, the at least one fly begins moving/flying. In some embodiments, the at least one user selects at least one piece of furniture the at least one fly will rest on and/or when.

Figure 8:
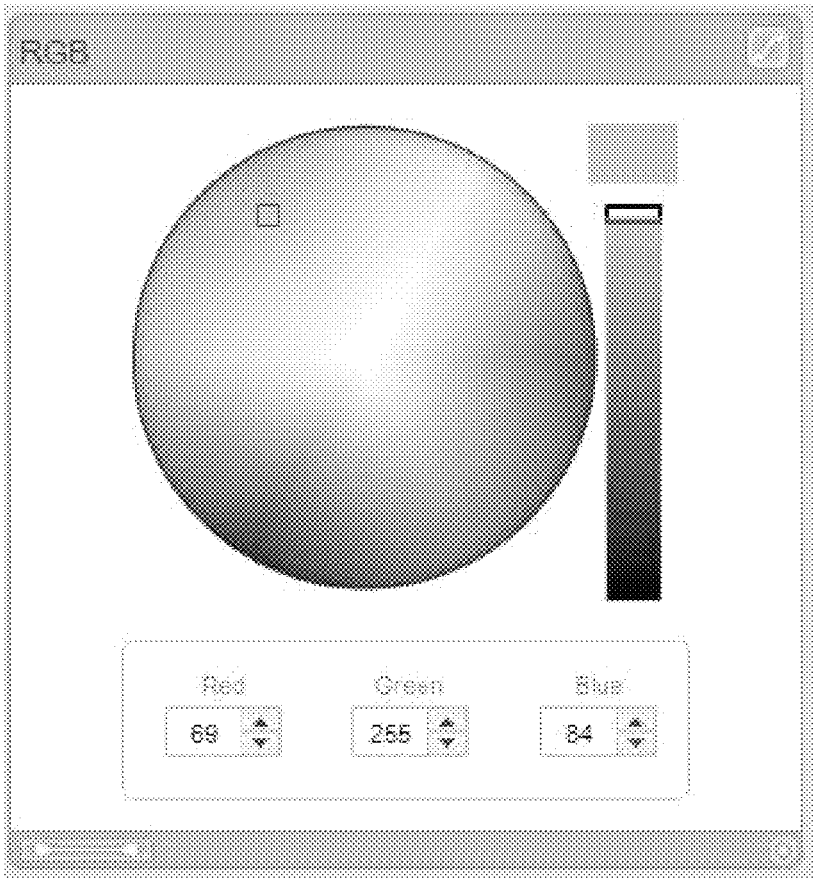
FIG. 8 illustrates shades of color for use in the proximity game generated by the system of the present invention, where each shade of color correlates with three values on a red/green/blue (R/G/B) scale.

FIG. 8 illustrates some further aspects of the present invention. In some embodiments, the lottery comprises proximity to at least one natural phenomena(s) that is assigned at least one 3D modeling representation, for example, at least one color. In some embodiments, at least one color is represented by/correlates with at least 3 different numbers, Red, Green, and/or Blue, the RGB model. In some embodiments, each number has at least one value ranging between 0 and 256. In some embodiments, combining these at least 3 numbers generates a large number of colors, e.g., millions of colors. In some embodiments, the sample space is 256*256*256=17,000,000 different colors. In some embodiments, each color is directed to at least one point in the 3D space. In some embodiments, the at least one user utilizes at least one color wheel on his specifically programmed computing device. In some embodiments, for example, the at least one user can (1) input at least one plain number on his or her own, like writing down (69, 255, 86), and see a color that appears, and/or (2) interactively select at least one color by clicking on at least one point on the at least one color wheel. In some embodiments, the at least one user selects at least one predefined color and modifies the at least one predefined color. In an embodiment, for example, the at least one user selects at least one shade of green, the draw begins, at least one color or a 3 digit number is randomly selected, and at least one winner(s) is decided based on proximity.

Figure 9:
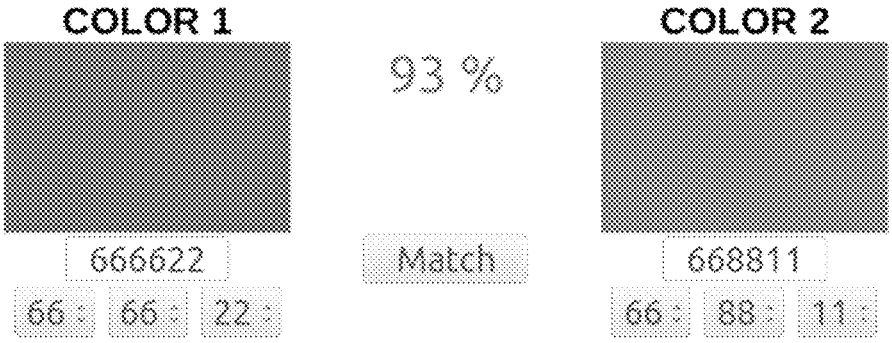
FIG. 9 illustrates an embodiment of color values generated by the game system of the present invention, showing color 1 correlating with a red value of 66, a green value of 66, and a blue value of 22 and color 2 correlating with a red value of 66, a green value of 88, and a blue value of 11. Colors 1 and 2 are shown to correlate with a 93% match, which can be used to determine proximity.

FIG. 9 illustrates some further aspects of the present invention. The chance of at least one jackpot, which requires at least one exact match, is 1/17,000,000. In an embodiment, to determine proximity, a computer-implemented method utilizes a percentage of resemblance between at least two colors, ranging from 0% to 100%. In an embodiment, a 100% resemblance corresponds with an award of the jackpot prize. In another embodiment, a 97-99% percentage corresponds with at least one award of at least one portion of the jackpot prize, e.g., half of the jackpot prize. In another embodiment, a 93-97% percentage corresponds with at least one award of at least one portion of a jackpot prize, e.g., a quarter of the jackpot prize, etc. FIG. 9 illustrates an embodiment of the present invention, where the at least one winning color is color 2 (66, 88, 11), and where the specifically programmed computer identifies the at least one user having selected color 1 (66, 66, 22) corresponding to a 93% percentage match compared with an exact match, and the specifically programmed computer awards at least one prize (corresponding to a percentage of a jackpot, e.g., a quarter of the jackpot).

In some embodiments, the lottery utilizes at least one instant win format. In some embodiments, the lottery utilizes at least one future draw format. In some embodiments, in the at least one instant win, the at least one user selects at least one number and a number is drawn by the specifically programmed computer immediately after. In some embodiments, at least one future draw game selects at least one user to share at least one prize(s) with at least one additional user, where at least one ticket is supplied (e.g. printed) with the at least one user selections. In some embodiments, the lottery utilizes the form of 3 numbers such as (66, 66, 22) and a description of the at least one color, e.g., 'olive green'. In some embodiments, the at least one receipt comprises at least one printed color. In some embodiments, the at least one ticket contains at least one bar code, where scanning the ticket in a specifically programmed computing device and/or entering the three numbers of RGB, the at least one user may identify the at least one corresponding color on a screen of a specifically programmed computer. In some embodiments, after the at least one drawing is held, the at least one ticket appears on the screen of a specifically programmed computer, e.g., as seen in FIG. 9, with the phrase, e.g., 'Not a Winner,' or information corresponding to at least one winning prize.

Figure 10:
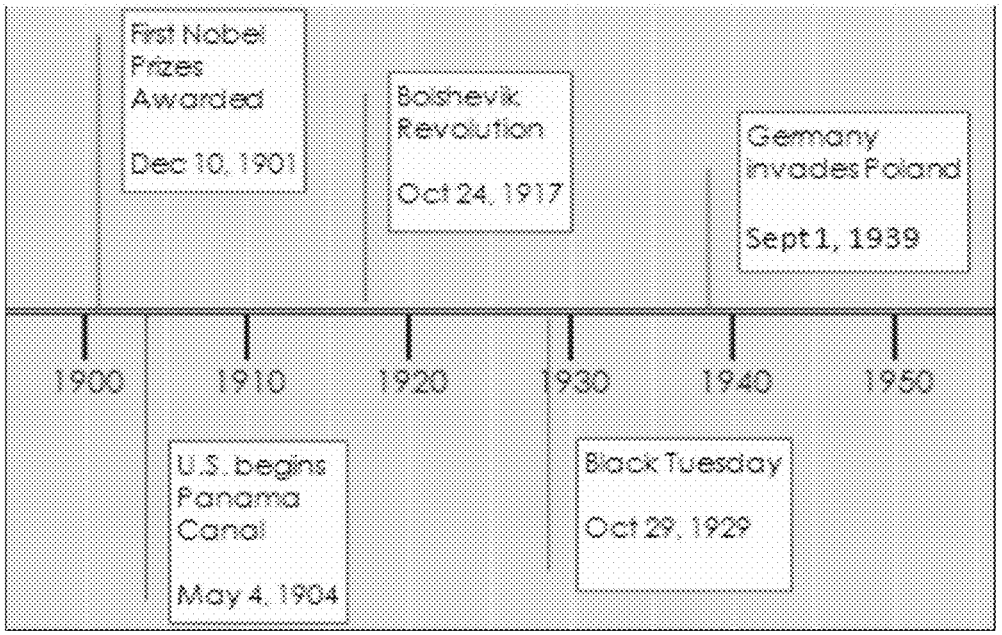
FIG. 10 illustrates an embodiment of the proximity game generated by the system of the present invention, showing several dates/times in history and historic events occurring on these dates/times in history. Each of these dates/times falls within a 50 year timeline.

FIG. 10 illustrates some further aspects of the present invention. In some embodiments, the lottery utilizes at least one historic time event. In some embodiments, the lottery utilizes at least one single dimensional game, with, e.g., time being the one dimension. In some embodiments, the at least one historic time event game provides at least one educational piece of information. In some embodiments, the at least one user selects the correct date. In some embodiments, the at least one user selects, for example, a date from 1900 to the current year (e.g., 2014), delivering a sample space of approximately 40,000 different dates. In some embodiments, the at least one user selects at least one country of interest that the at least one historic event occurred. In some embodiments, the at least one historic event serves as at least one bonus category. In an embodiment, at least one user selects at least one date: e.g., 12 Apr. 1970, and at least one country, e.g., the United States, and after the at least one selection(s), at least one winning historic date is drawn, for example Jul. 20, 1969, Man Lands on Moon, the country is: the United States.

In an embodiment, the probability of the at least one user picking the exact date is approximately 1/40,000. In some embodiments, based on proximity to the at least one winning date, the user wins at least one prize, where if the at least one user falls within at least one week to the winning date on the time line, the computer-implemented method will award at least one portion of the at least one jackpot, e.g., half of the at least one jackpot to the at least one user. In an embodiment, if at least one user falls within e.g., a month, the computer-implemented method awards at least one user a smaller portion of the jackpot, e.g., a quarter of jackpot, etc. In some embodiments, a computer-implemented method awards at least one bonus prize to at least one user when the at least one user correctly identifies the at least one country. In some embodiments, the correctly identified country(s) is directed to at least one parameter utilized by the specifically programmed computer as at least one multiplier to enhance the at least one winning prize. FIG. 10 illustrates at least one time line sample space.

Figure 11:
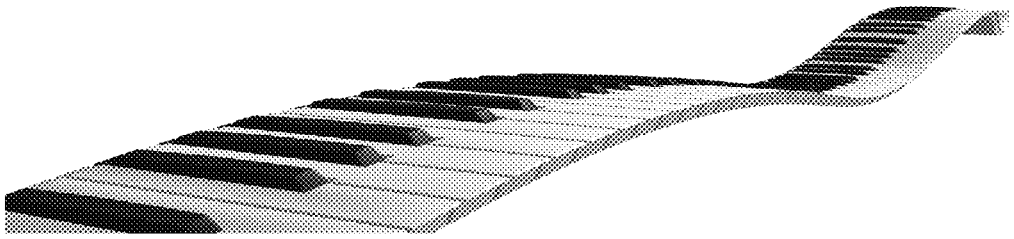
FIG. 11 illustrates an embodiment of the proximity game generated by the system of the present invention, showing 88 keys of a piano.

FIG. 11 illustrates some further aspects of the present invention. In some embodiments, the sound spectrum is directed to at least one continuous sample space. In an embodiment, at least one human is capable of hearing sounds ranging between 20 and 20,000 Hz. In an embodiment, a computer-implemented method records at least one user's selection and/or betting outcome of at least one sound from at least one virtual sound generator and/or at least one virtual instrument. In some embodiments, at least one frequency is assigned to the at least one selected sound. In some embodiments, the computer-implemented method provides at least one sample of the at least one sound so the at least one user can hear the at least one sound from the specifically programmed computational device when selecting it. In some embodiments, at least one winning sound is randomly selected. In some embodiments, based on how close at least one user is to the winning sound, the computer-implemented method awards at least one user at least one prize. In some embodiments, the at least one user interactively selects 3 notes from at least one virtual instrument, e.g., at least one piano, and assembles at least a 3 note melody. In an embodiment, at least one piano includes 88 notes, creating 88*88*88 combinations of notes, creating up to 680,000 different combinations (melody), where the chance of selecting and/or betting the exact musical tune is 1/680,000. In some embodiments, based on proximity to the at least one winning melody, where the proximity is computed through Euclidean distance in 3D space and/or musical harmony, the computer-implemented method awards at least one prize.

Figure 12:
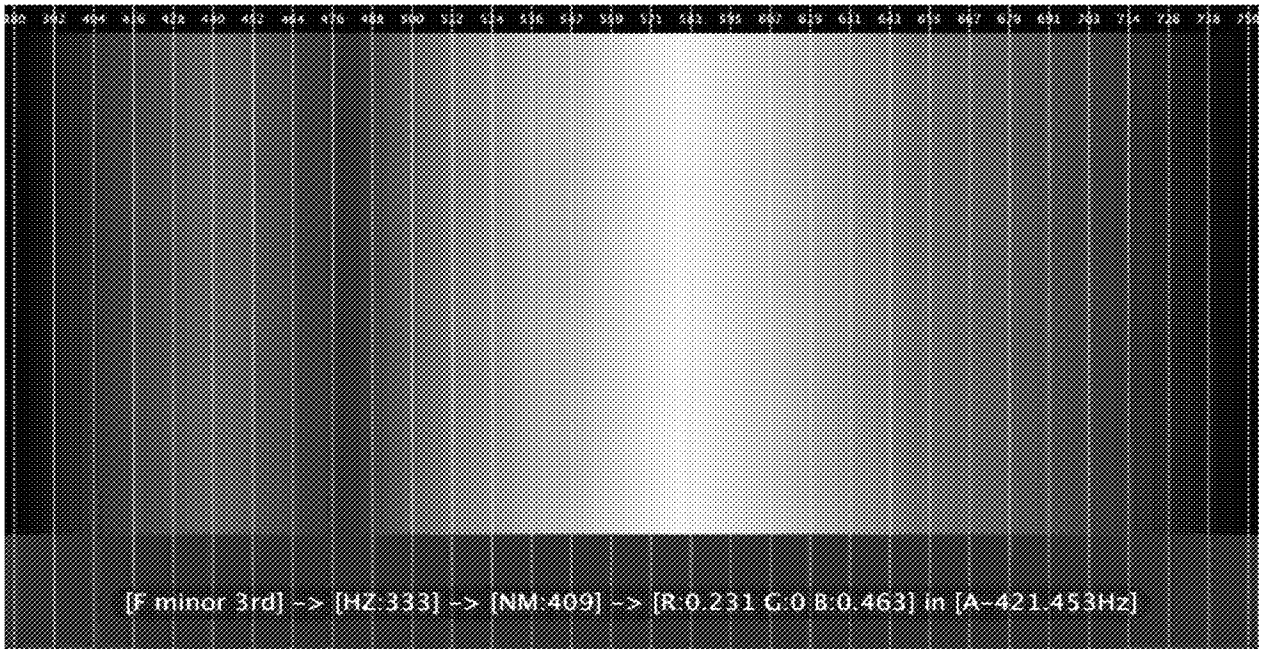
FIG. 12 illustrates an embodiment of the proximity game generated by the system of the present invention, showing the correlation of pitches/notes (i.e., F minor $3^{rd}$) with frequency of oscillations in wave motion, which are measured in Hertz (HZ).

FIG. 12 illustrates some further aspects of the present invention. In some embodiments, at least one lottery corresponding to at least one color proximity game which is played simultaneously with at least one musical game. In an embodiment, at least one non-winning ticket is given a second opportunity to win in the musical game, and vice versa. FIG. 12 illustrates the relationship between color and audio frequency. In some embodiments, at least two different lotteries can be played in combination, offering additional possibilities for at least one user(s) to win.

Figure 13:
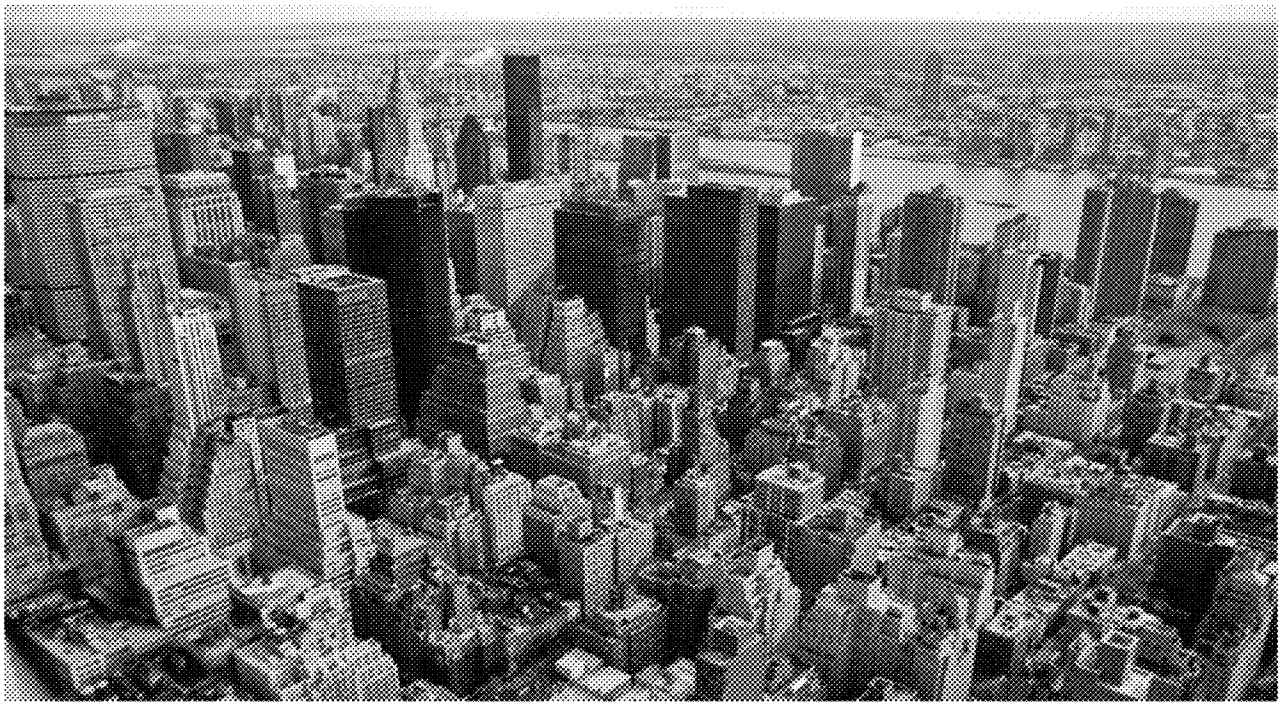
FIG. 13 illustrates an embodiment of the proximity game generated by the system of the present invention, showing an urban environment.

FIG. 13 illustrates some further aspects of the present invention. In some embodiments, at least one proximity game is directed to an urban landscape of a city (e.g., New York, Chicago, San Diego, San Francisco, Las Vegas, Boston, Washington D.C., Shanghai, London, Paris, etc.), and requires a computing device such as a specifically programmed personal PC (e.g., smartphone, tablet, etc.) or a specifically programmed lottery video terminal equipped with at least one tool such as Google Earth and/or a similar virtual tool to allow a 3D view of, e.g., New York. In an embodiment, the at least one user selects at least one skyscraper and/or at least one floor in the at least one skyscraper. In an embodiment, at least one virtual draw using a specifically programmed computer begins after the at least one selection and at least one skyscraper is randomly selected with at least one viewing tool, triggering at least one virtual elevator to move within the at least one skyscraper to select the winning floor. In some embodiments, at least one prize(s) will be awarded based on how 'close' (proximity) the at least one user was to the exact winning information(s). In an embodiment, the at least one user selected the at least one correct building but not the at least one correct floor, the computer-implemented methods in accordance with the present invention can award at least one prize. In an embodiment, if at least one user selects at least one building along a perimeter of at least one 1 city block, the computer-implemented method awards at least one smaller prize. In an embodiment, the geometric distance on 3D space is directed to determining the proximity to the winning point (e.g., at least one floor in a building).

Illustrative Operating Environments

FIG. 1 illustrates one embodiment of an environment in which the present invention may operate. However, not all of these components may be required to practice the invention, and variations in the arrangement and type of the components may be made without departing from the spirit or scope of the invention. In some embodiments, the inventive system and method may include a large number of members and/or concurrent transactions. In other embodiments, the inventive system and method are based on a scalable computer and network architecture that incorporates varies strategies for assessing the data, caching, searching, and database connection pooling. An example of the scalable architecture is an architecture that is capable of operating multiple servers.

In embodiments, members of the computer system 102-104 include virtually any computing device capable of receiving and sending a message over a network, such as network 105, to and from another computing device, such as servers 106 and 107, each other, and the like. In embodiments, the set of such devices includes devices that typically connect using a wired communications medium such as personal computers, multiprocessor systems, microprocessor-based or programmable consumer electronics, network PCs, and the like. In embodiments, the set of such devices also includes devices that typically connect using a wireless communications medium such as cell phones, smart phones, pagers, walkie talkies, radio frequency (RF) devices, infrared (IR) devices, CBs, integrated devices combining one or more of the preceding devices, or virtually any mobile device, and the like. Similarly, in embodiments, client devices 102-104 are any device that is capable of connecting using a wired or wireless communication medium such as a PDA, POCKET PC, wearable computer, and any other device that is equipped to communicate over a wired and/or wireless communication medium.

In embodiments, each member device within member devices 102-104 may include a browser application that is configured to receive and to send web pages, and the like. In embodiments, the browser application may be configured to receive and display graphics, text, multimedia, and the like, employing virtually any web based language, including, but not limited to Standard Generalized Markup Language (SMGL), such as HyperText Markup Language (HTML), a wireless application protocol (WAP), a Handheld Device Markup Language (HDML), such as Wireless Markup Language (WML), WMLScript, XML, JavaScript, and the like. In embodiments, programming may include either Java, .Net, QT, C, C++ or other suitable programming language.

In embodiments, member devices 102-104 may be further configured to receive a message from another computing device employing another mechanism, including, but not limited to email, Short Message Service (SMS), Multimedia Message Service (MMS), instant messaging (IM), internet relay chat (IRC), mIRC, Jabber, and the like or a Proprietary protocol.

In embodiments, network 105 may be configured to couple one computing device to another computing device to enable them to communicate. In some embodiments, network 105 may be enabled to employ any form of computer readable media for communicating information from one electronic device to another. Also, in embodiments, network 105 may include a wireless interface, and/or a wired interface, such as the Internet, in addition to local area networks (LANs), wide area networks (WANs), direct connections, such as through a universal serial bus (USB) port, other forms of computer-readable media, or any combination thereof. In embodiments, on an interconnected set of LANs, including those based on differing architectures and protocols, a router may act as a link between LANs, enabling messages to be sent from one to another.

Also, in some embodiments, communication links within LANs typically include twisted wire pair or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links including satellite links, or other communications links known to those skilled in the art. Furthermore, in some embodiments, remote computers and other related electronic devices could be remotely connected to either LANs or WANs via a modem and temporary telephone link. In essence, in some embodiments, network 105 includes any communication method by which information may travel between client devices 102-104, and servers 106 and 107.

FIG. 2 shows another exemplary embodiment of the computer and network architecture that supports the methods and systems of the instant invention. In some embodiments, the member devices 202*a*, 202*b* thru 202*n* shown each at least includes a computer-readable medium, such as a random access memory (RAM) 208 coupled to a processor 210 or FLASH memory. In some embodiments, the processor 210 may execute computer-executable program instructions stored in memory 208. In some embodiments, such processors comprise a microprocessor, an ASIC, and state machines. In some embodiments, such processors comprise, or may be in communication with, media, for example computer-readable media, which stores instructions that, when executed by the processor, cause the processor to perform the steps described herein. Embodiments of computer-readable media may include, but are not limited to, an electronic, optical, magnetic, or other storage or transmission device capable of providing a processor, such as the processor 210 of client 202*a*, with computer-readable instructions. In some embodiments, other examples of suitable media may include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media may transmit or carry instructions to a computer, including a router, private or public network, or other transmission device or channel, both wired and wireless. In some embodiments, the instructions may comprise code from any computer-programming language, including, for example, C, C++, Visual Basic, Java, Python, Perl, and JavaScript.

In some embodiments, member devices 202*a-n* may also comprise a number of external or internal devices such as a mouse, a CD-ROM, DVD, a keyboard, a display, or other input or output devices. Examples of client devices 202*a-n* may be personal computers, digital assistants, personal digital assistants, cellular phones, mobile phones, smart phones, pagers, digital tablets, laptop computers, Internet appliances, and other processor-based devices. In general, a client device 202*a* may be any type of processor-based platform that is connected to a network 206 and that interacts with one or more application programs. Client devices 202*a-n* may operate on any operating system capable of supporting a browser or browser-enabled application, such as Microsoft™, Windows™, or Linux. The client devices 202*a-n* shown may include, for example, personal computers executing a browser application program such as Microsoft Corporation's Internet Explorer™, Apple Computer, Inc.'s Safari™, Mozilla Firefox, and Opera. Through the client devices 202*a-n*, users, 212*a-n* communicate over the network 206 with each other and with other systems and devices coupled to the network 206. As shown in FIG. 1B, server devices 204 and 213 may be also coupled to the network 206. In an embodiment of the present invention, one or more clients can be a mobile client.

In some embodiments, the term "mobile electronic device" may refer to any portable electronic device that may or may not be enabled with location tracking functionality. For example, a mobile electronic device can include, but is not limited to, a mobile phone, Personal Digital Assistant (PDA), Blackberry™, Pager, Smartphone, or any other reasonable mobile electronic device. For ease, at times the above variations are not listed or are only partially listed, this is in no way meant to be a limitation.

In some embodiments, the terms "proximity detection," "locating," "location data," "location information," and "location tracking" as used herein may refer to any form of location tracking technology or locating method that can be used to provide a location of a mobile electronic device, such as, but not limited to, at least one of location information manually input by a user, such as, but not limited to entering the city, town, municipality, zip code, area code, cross streets, or by any other reasonable entry to determine a geographical area; Global Positions Systems (GPS); GPS accessed using Bluetooth™; GPS accessed using any reasonable form of wireless and/or non-wireless communication; WiFi™ server location data; Bluetooth™ based location data; triangulation such as, but not limited to, network based triangulation, WiFi™ server information based triangulation, Bluetooth™ server information based triangulation; Cell Identification based triangulation, Enhanced Cell Identification based triangulation, Uplink-Time difference of arrival (U-TDOA) based triangulation, Time of arrival (TOA) based triangulation, Angle of arrival (AOA) based triangulation; techniques and systems using a geographic coordinate system such as, but not limited to, longitudinal and latitudinal based, geodesic height based, cartesian coordinates based; Radio Frequency Identification such as, but not limited to, Long range RFID, Short range RFID; using any form of RFID tag such as, but not limited to active RFID tags, passive RFID tags, battery assisted passive RFID tags; or any other reasonable way to determine location. For ease, at times the above variations are not listed or are only partially listed, this is in no way meant to be a limitation.

In some embodiments, near-field wireless communication (NFC) can represent a short-range wireless communications technology in which NFC-enabled devices are "swiped," "bumped," "tap" or otherwise moved in close proximity to communicate. In some embodiments, NFC could include a set of short-range wireless technologies, typically requiring a distance of 10 cm or less.

In some embodiments, NFC may operate at 13.56 MHz on ISO/IEC 18000-3 air interface and at rates ranging from 106 kbit/s to 424 kbit/s. In some embodiments, NFC can involve an initiator and a target; the initiator actively generates an RF field that can power a passive target. In some embodiment, this can enable NFC targets to take very simple form factors such as tags, stickers, key fobs, or cards that do not require batteries. In some embodiments, NFC peer-to-peer communication can be conducted when a plurality of NFC-enable devices within close proximity of each other.

In some embodiments, proximity games of the present invention are conducted utilizing NFC devices that can include, but are not limited to, one or more Smart Proximity Poster (SPP) or a Smart Proximity Spot ("SPS") having one or more wireless tags ("NFC tags"). In some embodiments, NFC tagged spots (SPP, SPS) can be in one or more of the following formats or other: wall posters, street posters, POS (point of service locations), terminals, newspapers, magazines, NFC-enabled TV, etc.

In some embodiments, players' NFC-enabled devices selectively recognize only certain NFC tagged spots (SPP, SPS or other NFC-tagged spots in cooperation with the Proximity Game Host) and disregard others (e.g., NFC tagged spots belonging to a particular retailer).

In some embodiments, NFC taps location must be known by the proximity game host system.

In some embodiments, players' NFC-enabled devices must be enabled for mobile client tracking.

In some embodiments, one or more NFC tags can be arranged on a SPP in a particular grid arrangement. In some embodiments, the NFC tags can be overlaid with an artistic drawing, so that, for example, on top of each tag one corresponding lottery game indicia, e.g. number, is shown. In some embodiments, each NFC tag can be assigned the lottery indicia, e.g. shown over it on the overlay. In some embodiments, the NFC tags (and therefore their respective indicia, e.g. numbers) can be arranged in an orderly manner on the grid, for example following a numeric order.

In some embodiments, a potential player of lottery, who owns an NFC-enabled personal device (mobile phone, PDA, tablet etc) and wishes to participate in a proximity game, can walk up to a NFC spot, e.g. SPP, and select their proximity game participation options by bringing the NFC device in a proximity to (or tap on) the desired indicia, e.g. number(s), on the SLP, one by one. In some embodiments, this action can be repeated for as many indicia, e.g. numbers, as desired. In some embodiments, during the process of communicating with the SLS, the NFC-enabled device will interrogate for the proximity of an NFC tag, and, if a tag is detected, the tag is interrogated about its number assignment. In some embodiments, the NFC tag can respond with a proximity game indicia, e.g. number, assigned to it and the device can store the tag responses (and therefore the player selections) using a software programmed to receive and communicate information utilizing NFC protocols. In some embodiments, a set of selected numbers can be used to create an electronic proximity game play slip which can then be transferred to a proximity game conducting agency for validation, using, for example, an electronic message, or a barcode formed on the device screen, or any other suitable technologies.

For purposes of the instant description, the terms "cloud," "Internet cloud," "cloud computing," "cloud architecture," and similar terms correspond to at least one of the following: (1) a large number of computers connected through a real-time communication network (e.g., Internet); (2) providing the ability to run a program or application on many connected computers (e.g., physical machines, virtual machines (VMs)) at the same time; (3) network-based services, which appear to be provided by real server hardware, and are in fact served up by virtual hardware (e.g., virtual servers), simulated by software running on one or more real machines (e.g., allowing to be moved around and scaled up (or down) on the fly without affecting the end user). In some embodiments, the instant invention offers/manages the cloud computing/architecture as, but not limiting to: infrastructure a service (IaaS), platform as a service (PaaS), and software as a service (SaaS). FIGS. 3 and 4 illustrate schematics of exemplary implementations of the cloud computing/architecture.

Of note, the embodiments described herein may, of course, be implemented using any appropriate computer system hardware and/or computer system software. In this regard, those of ordinary skill in the art are well versed in the type of computer hardware that may be used (e.g., a mainframe, a mini-computer, a personal computer ("PC"), a network (e.g., an intranet and/or the internet)), the type of computer programming techniques that may be used (e.g., object oriented programming), and the type of computer programming languages that may be used (e.g., C++, Basic, AJAX, Javascript). The aforementioned examples are, of course, illustrative and not restrictive.

In some embodiments, the instant invention provides for a game-operating computer system, including: at least one server and game-operating software stored on a non-transient computer readable medium accessible by the at least one server, where the at least one server, executing game-operating software, is at least configured to: generate, in real time, an instance of a proximity game, where the instance of the proximity game is played based, at least in part, on the following rules: a) selecting, in real time, by the game-operating software, a plurality of winning values from a pool of values, where the plurality of winning values include: (1) A as a first selected winning value, (2) B as a second selected winning value, and (3) C as a third selected winning value;

b) electronically receiving, in real time, from at least one first player of the plurality of players, via a first graphical user interface, a first plurality of player-selected values from the pool of values, where the first plurality of player-selected values include: (1) X(1) value, (2) Y(1) value, and (3) Z(1) value; c) electronically receiving, in real time, from at least one second player of the plurality of players, via a second graphical user interface, a second plurality of player-selected values from the pool of values, where the second plurality of player-selected values include: (1) X(2) value, (2) Y(2) value, and (3) Z(2) value; d) comparing, in real time, by the game-operating software, the A, B, and C values to: i) the X(1), Y(1), and Z(1) values selected by the at least one first player, and ii) the X(2), Y(2), and Z(2) values selected by the at least one second player, by at least: calculating, in real time, a first proximity of the A, B, and C values to the X(1), Y(1), and Z(1) values based, at least in part, on at least one predetermined comparing order; calculating, in real time, a second proximity of the A, B, and C values to the X(2), Y(2), and Z(2) values based, at least in part, on the at least one predetermined comparing order; where at least one player-selected value of the X(1), Y(1), and Z(1) values is not equal to at least one winning value of the A, B, and C values; and where at least one player-selected value of the X(2), Y(2), and Z(2) values is not equal to at least one winning value of the A, B, and C values; and e) determining, in real time, by the game-operating software, at least one winning player from the at least one first player and the at least one second player, based, at least in part, on: comparing, in real time, by the game-operating software, the first proximity to the second proximity.

In some embodiments, the proximity game is further based, at least in part, on the following rule: distributing, in real time, by the game-operating software, a prize to the at least one winning player. In some embodiments, the game-operating software, is further configured to: receive, in real time, a first payment from the at least one first player of the plurality of players and a second payment from the at least one second player of the plurality of players. In some embodiments, the pool of values corresponds to at least one point in a geometric space, at least one color, at least one auditory note, at least one geographic location, at least one event, at least one description of taste, or any combination thereof. In some embodiments, the at least one event includes historical events, political events, cultural events, financial events, athletic events, musical events, or any combination thereof. In some embodiments, (i) X(1) is compared to A; (ii) Y(1) is compared to B; (iii) Z(1) is compared to C; and the first proximity is calculated using a first Euclidean formula:

$$\sqrt{(A-X(1))^2+(B-Y(1))^2+\ldots+(C-Z(1))^2}; \text{ and}$$

(i) X(2) is compared to A; (ii) Y(2) is compared to B; (iii) Z(2) is compared to C; and the second proximity is calculated using a second Euclidean formula:

$$\sqrt{(A-X(2))^2+(B-Y(2))^2+\ldots+(C-Z(2))^2}.$$

In some embodiments, the A, B, and C values correlate with the at least one point in the three-dimensional space, defined by: (i) an X-coordinate, (ii) a Y-coordinate, and (iii) a Z-coordinate.

In some embodiments, the instant invention provides for a game-operating computer method, including: generating, in real time, by at least one server and game-operating software stored on a non-transient computer readable medium accessible by the at least one server, an instance of a proximity game, where the instance of the proximity game is played based, at least in part, on the following rules: a) selecting, in real time, by the game-operating software, a plurality of winning values from a pool of values, where the plurality of winning values includes: (1) A as a first selected winning value, (2) B as a second selected winning value, and (3) C as a third selected winning value; b) electronically receiving, in real time, from at least one first player of the plurality of players, via a first graphical user interface, a first plurality of player-selected values from the pool of values, where the first plurality of player-selected values include: (1) X(1) value, (2) Y(1) value, and (3) Z(1) value; c) electronically receiving, in real time, from at least one second player of the plurality of players, via a second graphical user interface, a second plurality of player-selected values from the pool of values, where the second plurality of player-selected values include: (1) X(2) value, (2) Y(2) value, and (3) Z(2) value; d) comparing, in real time, by the game-operating software, the A, B, and C values to: i) the X(1), Y(1), and Z(1) values selected by the at least one first player, and ii) the X(2), Y(2), and Z(2) values selected by the at least one second player, by at least: calculating, in real time, a first proximity of the A, B, and C values to the X(1), Y(1), and Z(1) values based, at least in part, on at least one predetermined comparing order; calculating, in real time, a second proximity of the A, B, and C values to the X(2), Y(2), and Z(2) values based, at least in part, on the at least one predetermined comparing order; where at least one player-selected value of the X(1), Y(1), and Z(1) values is not equal to at least one winning value of the A, B, and C values; and where at least one player-selected value of the X(2), Y(2), and Z(2) values is not equal to at least one winning value of the A, B, and C values; and e) determining, in real time, by the game-operating software, at least one winning player from the at least one first player and the at least one second player, based, at least in part, on: comparing, in real time, by the game-operating software, the first proximity to the second proximity.

In some embodiments, the proximity game is further based, at least in part, on the following rule: distributing, in real time, by the game-operating software, a prize to the at least one winning player. In some embodiments, the game-operating computer method further includes: receiving, in real time, a first payment from the at least one first player of the plurality of players and a second payment from the at least one second player of the plurality of players. In some embodiments, the pool of values corresponds to at least one point in a geometric space, at least one color, at least one auditory note, at least one geographic location, at least one event, at least one description of taste, or any combination thereof. In some embodiments, the at least one event includes historical events, political events, cultural events, financial events, athletic events, musical events, or any combination thereof. In some embodiments, (i) X(1) is compared to A; (ii) Y(1) is compared to B; (iii) Z(1) is compared to C; and the first proximity is calculated using a first Euclidean formula:

$$\sqrt{(A-X(1))^2+(B-Y(1))^2+\ldots+(C-Z(1))^2}; \text{ and}$$

(i) X(2) is compared to A; (ii) Y(2) is compared to B; (iii) Z(2) is compared to C; and the second proximity is calculated using a second Euclidean formula:

$$\sqrt{(A-X(2))^2+(B-Y(2))^2+\ldots+(C-Z(2))^2}.$$

In some embodiments, the A, B, and C values correlate with the at least one point in the three-dimensional space, defined by: (i) an X-coordinate, (ii) a Y-coordinate, and (iii) a Z-coordinate.

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

What is claimed is:

1. A game-operating computer system, comprising:

at least one server and game-operating software stored on a non-transient computer readable medium accessible by the at least one server, wherein the at least one server, executing the game-operating software, is at least configured to:

perform a function of a random number generator to randomly select, in real time a plurality of winning values from a pool of values, wherein the plurality of winning values comprise:

1) A as a first selected winning value,

2) B as a second selected winning value, and

3) C as a third selected winning value;

wherein the pool of values corresponds to a plurality of points in a geometric space, a plurality of colors, a plurality of auditory notes, a plurality of geographic locations, a plurality of events, a plurality of taste descriptions, or any combination thereof;

electronically receive, in real time, a first payment from at least one first player;

electronically receive, in real time, from the at least one first player, via a first graphical user interface, a first plurality of player-selected values from the pool of values, wherein the first plurality of player-selected values comprise:

1) X(1) value,

2) Y(1) value, and

3) Z(1) value;

electronically receive, in real time, a second payment from at least one second player;

electronically receive, in real time, from at least one second player, via a second graphical user interface, a second plurality of player-selected values from the pool of values, wherein the second plurality of player-selected values comprise:

1) X(2) value, 2) Y(2) value, and 3) Z(2) value; dynamically compare, in real time, by the game-operating software, the A, B, and C values to:

i) the X(1), Y(1), and Z(1) values selected by the at least one first player, and ii) the X(2), Y(2), and Z(2) values selected by the at least one second player, by at least:

calculating, in real time, at least one first proximity of the A, B, and C values to the X(1), Y(1), and Z(1) values;

calculating, in real time, at least one second proximity of the A, B, and C values to the X(2), Y(2), and Z(2) values;

wherein at least one player-selected value of the X(1), Y(1), and Z(1) values is not equal to at least one winning value of the A, B, and C values; and wherein at least one player-selected value of the X(2), Y(2), and Z(2) values is not equal to at least one winning value of the A, B, and C values;

dynamically compare, in real time, by the game-operating software, the at least one first proximity to the at least one second proximity to determine at least one closest proximity to at least one winning value of the plurality of winning values between the at least one first proximity and the at least one second proximity;

dynamically determine, in real time, that the at least one closest proximity is within at least one winning zone of a plurality of winning zones;

wherein each winning zone of the plurality of winning zones is at a pre-determined distance away from the at least one winning value of the plurality of winning values;

wherein the pre-determined distance corresponds to a probability of winning; and dynamically cause to distribute the at least one prize to a corresponding winning player from the at least one first player and the at least one second player based on the determining that the at least one closest proximity is within at least one winning zone of a plurality of winning zone, wherein the at least one prize is: at least one physical item representative of a monetary value of the at least one prize, an electronic payment representative of the monetary value of the at least one prize: or a combination thereof.

2. The game-operating computer system of claim 1, wherein the at least one event comprises historical events, political events, cultural events, financial events, athletic events, musical events, or any combination thereof.

3. The game-operating computer system of claim 1, wherein i. X(1) is compared to A;

ii. Y(1) is compared to B;

iii. Z(1) is compared to C; and wherein the first proximity is calculated using a first Euclidean formula:

$$\sqrt{(A-X(1))^2+(B-Y(1))^2+\ldots+(C-Z(1))^2}; \text{ and}$$

wherein i. X(2) is compared to A;

ii. Y(2) is compared to B;

iii. Z(2) is compared to C; and wherein the second proximity is calculated using a second Euclidean formula:

$$\sqrt{(A-X(2))^2+(B-Y(2))^2+\ldots+(C-Z(2))^2}.$$

4. The game-operating computer system of claim 1, wherein the A, B, and C values correlate with at least one point in a three-dimensional space, defined by:

i. an X-coordinate, ii. a Y-coordinate, and iii. a Z-coordinate.

5. A game-operating computer method, comprising:

instructing at least one processor to execute a plurality of software instructions so that the at least one processor is configured to perform at least the following computer operations:

performing a function of a random number generator to randomly select, in real time a plurality of winning values from a pool of values, wherein the plurality of winning values comprise:

1) A as a first selected winning value,

2) B as a second selected winning value, and

3) C as a third selected winning value;

wherein the pool of values corresponds to a plurality of points in a geometric space, a plurality of colors, a plurality of auditory notes, a plurality of geographic locations, a plurality of events, a plurality of taste descriptions, or any combination thereof;

electronically receiving, in real time, a first payment from at least one first player;

electronically receiving, in real time, from the at least one first player, via a first graphical user interface, a first plurality of player-selected values from the pool of values, wherein the first plurality of player-selected values comprise:

4) X(1) value,

5) Y(1) value, and

6) Z(1) value;

electronically receiving, in real time, a second payment from at least one second player;

electronically receiving, in real time, from at least one second player, via a second graphical user interface, a second plurality of player-selected values from the pool of values, wherein the second plurality of player-selected values comprise:

1) X(2) value,

2) Y(2) value, and

3) Z(2) value;

dynamically comparing, in real time, by the game-operating software, the A, B, and C values to:

i) the X(1), Y(1), and Z(1) values selected by the at least one first player, and ii) the X(2), Y(2), and Z(2) values selected by the at least one second player, by at least:

calculating, in real time, at least one first proximity of the A, B, and C values to the X(1), Y(1), and Z(1) values;

calculating, in real time, at least one second proximity of the A, B, and C values to the X(2), Y(2), and Z(2) values;

wherein at least one player-selected value of the X(1), Y(1), and Z(1) values is not equal to at least one winning value of the A, B, and C values; and wherein at least one player-selected value of the X(2), Y(2), and Z(2) values is not equal to at least one winning value of the A, B, and C values;

dynamically comparing, in real time, by the game-operating software, the at least one first proximity to the at least one second proximity to determine at least one closest proximity to at least one winning value of the plurality of winning values between the at least one first proximity and the at least one second proximity;

dynamically determining, in real time, that the at least one closest proximity is within at least one winning zone of a plurality of winning zones;

wherein each winning zone of the plurality of winning zones is at a pre-determined distance away from the at least one winning value of the plurality of winning values;

wherein the pre-determined distance corresponds to a probability of winning;

dynamically causing to distribute the at least one prize to a corresponding winning player from the at least one first player and the at least one second player based on the determining that the at least one closest proximity is within at least one winning zone of a plurality of winning zones, wherein the at least one prize is: at least one physical item representative of a monetary value of the at least one prize, an electronic payment representative of the monetary value of the at least one prize; or a combination thereof.

6. The game-operating computer method of claim 5, wherein the at least one event comprises historical events, political events, cultural events, financial events, athletic events, musical events, or any combination thereof.

7. The game-operating computer method of claim 5, wherein iv. X(1) is compared to A;

v. Y(1) is compared to B;

vi. Z(1) is compared to C; and wherein the first proximity is calculated using a first Euclidean formula:

$$\sqrt{(A-X(1))^2+(B-Y(1))^2+\ldots+(C-Z(1))^2}; \text{ and}$$

wherein i. X(2) is compared to A;

ii. Y(2) is compared to B;

iii. Z(2) is compared to C; and wherein the second proximity is calculated using a second Euclidean formula:

$$\sqrt{(A-X(2))^2+(B-Y(2))^2+\ldots+(C-Z(2))^2}.$$

8. The game-operating computer method of claim 7, wherein each winning zone of the plurality of winning zones is defined based on an Euclidean distance from the at least one winning value of the plurality of winning values.

9. The game-operating computer method of claim 5, wherein the A, B, and C values correlate with at least one point in a three-dimensional space, defined by:

i. an X-coordinate, ii. a Y-coordinate, and iii. a Z-coordinate.

10. The game-operating computer system of claim 3, wherein each winning zone of the plurality of winning zones is defined based on an Euclidean distance from the at least one winning value of the plurality of winning values.

* * * * *